United States Patent [19]

Dedow

[11] Patent Number: 4,496,406

[45] Date of Patent: Jan. 29, 1985

[54] METHOD OF MAKING A CONDUCTIVE RESEALABLE POUCH

[75] Inventor: Karen A. Dedow, West Covina, Calif.

[73] Assignee: General Dynamics, Pomona Division, Pomona, Calif.

[21] Appl. No.: 512,182

[22] Filed: Jul. 11, 1983

Related U.S. Application Data

[62] Division of Ser. No. 429,872, Sep. 30, 1982, Pat. No. 4,471,872.

[51] Int. Cl.[3] ..... B32B 31/10; B65D 85/42

[52] U.S. Cl. ..... 156/66; 24/442; 156/290; 156/308.4; 206/328; 383/11; 383/95; 428/922

[58] Field of Search ..... 24/306, 442; 156/66, 156/290, 308.4; 206/328; 383/11, 95; 428/457, 922

[56] References Cited

U.S. PATENT DOCUMENTS

| | | | |
|---|---|---|---|
| 2,866,920 | 12/1958 | Haagensen . | |
| 2,919,797 | 1/1960 | McCracken | 206/ |
| 3,256,981 | 6/1966 | Kurtz | 206/56 |
| 3,265,945 | 8/1966 | Jennings et al. . | |
| 3,768,724 | 10/1973 | Hill | 229/53 |
| 3,826,296 | 7/1974 | Morris | 150/32 X |
| 3,904,031 | 9/1975 | Kessler | 206/328 |
| 4,154,344 | 5/1979 | Yenni et al. | 206/328 X |
| 4,160,503 | 7/1979 | Ohlbach | 206/328 |
| 4,223,368 | 9/1980 | Dattilo | 206/328 X |
| 4,231,901 | 11/1980 | Berbeco | 206/328 X |
| 4,241,829 | 12/1980 | Hardy | 206/328 |
| 4,247,002 | 1/1981 | Horian | 206/313 |
| 4,267,927 | 5/1981 | English, Jr. | 206/328 X |
| 4,293,070 | 10/1981 | Ohlbach | 206/328 |
| 4,309,466 | 1/1982 | Stillman | 428/35 |
| 4,327,832 | 5/1982 | de Matteo | 206/328 |

FOREIGN PATENT DOCUMENTS 2821182 11/1979 Fed. Rep. of Germany .

*Primary Examiner*—Robert Dawson

*Attorney, Agent, or Firm*—Henry M. Bissell; Edward B. Johnson

[57] ABSTRACT

A pouch for protecting electrosensitive components contained therein from physical shock and electrostatic damage during handling and storage. In one embodiment, the pouch comprises two composite panels, each comprising a sheet of conductive material as the outside layer, a sheet of electrostatic-free material as the inside layer and a layer of open cell cushioning material sandwiched therebetween. Each panel is sealed to enclose the material therein and both panels are then sealed together on both sides and one end. The open end has an interlocking closure to allow components to be inserted into the pouch and for the pouch to be thereafter closed.

In another embodiment, the pouch is formed of a pair of extruded, tubular members respectively constituting the conductive material layer and the electrostatic-free material layer with sheets of cushioning material sandwiched between them. The assembly is sealed at one end and provided with a releasable closure member at the other end.

The pouch may also be formed as an elongated sandwich of the three material layers described, folded in half lengthwise and sealed along the side edges.

4 Claims, 7 Drawing Figures

METHOD OF MAKING A CONDUCTIVE RESEALABLE POUCH

This is a division of application Ser. No. 429,872, filed Sept. 30, 1982 and now U.S. Pat. No. 4,471,872.

BACKGROUND OF THE INVENTION

1. Field of the Invention

This invention relates to pouch containers and, more particularly, to pouch containers for protecting during transport electronic components which are sensitive to electrostatic influences.

2. Description of the Prior Art

Containers for transporting electrostatic-sensitive electronic components have severe design constraints imposed thereon. In particular, various electronic components such as metal oxide semiconductors (MOS), thick and thin film deposited products and other similar devices are highly sensitive to accumulations and discharging of electric charge, an excess accumulation of which may severely damage the device. Precautions typically taken to minimize static electric discharges through the devices during shipment include the use of shorting bars to ground the leads of the device. Also, some devices or components are manufactured with built-in zener diodes to provide protection from low-energy sources.

Although the foregoing techniques are normally adequate to protect the transported components from harmful electrostatic influences, it is sometimes necessary to provide yet additional protection. Such additional protection frequently takes the form of a shipping enclosure commonly referred to as a Faraday cage. A Faraday cage may be defined as a system of conductors forming an essentially continuous conducting mesh or network about the object protected and may include conductors necessary for interconnection between the object protected and an adequate ground. A typical prior art Faraday cage-type shipping enclosure has taken the form of an injection molded plastic container formed around a wire mesh screen in which the wire mesh screen forms an equipotential surface protecting the enclosed device from external electrostatic influences. In addition, the conductors forming the equipotential surface serve to dissipate any accumulation of electric charge built up on the enclosed devices by providing a conductive path between the devices and a source of ground potential.

The shipping container disclosed in U.S. Pat. No. 4,241,829 of Hardy provides a Faraday cage-type enclosure designed to protect the enclosed components from damage resulting from physically disturbing or stressing the container. The container comprises a box-like structure having a bottom, a pair of opposed side walls, a pair of opposed end walls and a top movable between an open and a closed position. A conductive coating is formed overlying substantially the entire interior and exterior surfaces of the box-like structure and includes a portion extending continuously therebetween. A linear of convoluted foam impregnated with a conductive material is secured to the interior surfaces of the top and bottom of the container, the impregnated conductive material forming a continuous conductive path with the conductive coating. The container then forms a Faraday cage-type enclosure providing increased protection from electrostatic influences by establishing a conductive shield of extremely high integrity, the convoluted foam liners promoting intimate contact between the conductive shield and the protected components.

German Offenlegungsschrift No. 2821182 discloses a packaging bag for electronic components that could be damaged by electrostatic charge. The bag comprises a single electrically conductive plastic film and a single transparent piece of plastic film, the films being edge welded together.

U.S. Pat. No. 3,768,724 of Hill discloses a cushioned shipping bag for protecting articles, including electronic components, during shipment. The bag includes two outer bag walls made of a material which is readily heat sealed, two layers of cushioning material and, in one embodiment, two additional inner bag walls. A Faraday cage is not provided.

U.S. Pat. No. 4,247,002 of Horian discloses an envelope for storing phonograph records, the envelope being made from extruded plastic film having an anti-static agent extruded within the film. The envelope has a closed end and sides, the open end and the plastic layers have cooperable projections that are snapped into engagement with each other to provide a seal for the envelope.

Although the aforementioned references disclose various techniques for transporting articles, including electronic components, which protect the article during transport from damage due to electrostatic charge and physical causes, there is still a need for a flexible, pouch-like container having a Faraday cage with a simplified construction which is particularly useful for protecting a sensitive electronic device during production line assembly work on the device.

SUMMARY OF THE INVENTION

In brief, arrangements in accordance with the present invention comprise a pouch for preventing physical shock and electrostatic damage to electrosensitive components contained within the pouch. Each pouch includes two composite panels, each panel comprising a sheet of conductive material as the outside layer, a sheet of electrostatic-free material as the inside layer and a layer of cushioning material sandwiched therebetween. Each panel is sealed to enclose the material therein and both panels are then sealed together on both sides and one end. The remaining end has an interlocking enclosure to allow components to be inserted into the pouch and for the pouch to be thereafter closed and opened easily so that the enclosed components may be removed and re-inserted for work at successive work stations. In one alternate arrangement of the invention, the inside and outside layers of the pouch may be formed by extruding the respective materials with one extrusion being of slightly lesser diameter and placed within the other, and the cushioning material be inserted as layers between the two tubular members. Sealing along the two side edges is thus obviated, although it may be desirable to develop a fold or crimp line at these two edges to develop a flatter package. Also the releasable end closure in this embodiment is formed at an extended flap on one side which folds over for sealing on the other side through the use of a suitable Velcro closure.

In still another arrangement of the invention, the respective panels may be preassembled and then folded over to form the closed end of the pouch. Further sealing is then provided along the side edges to complete the pouch. A suitable release closure for the remaining open end may be provided, as described.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENT(S)

Figure 1:
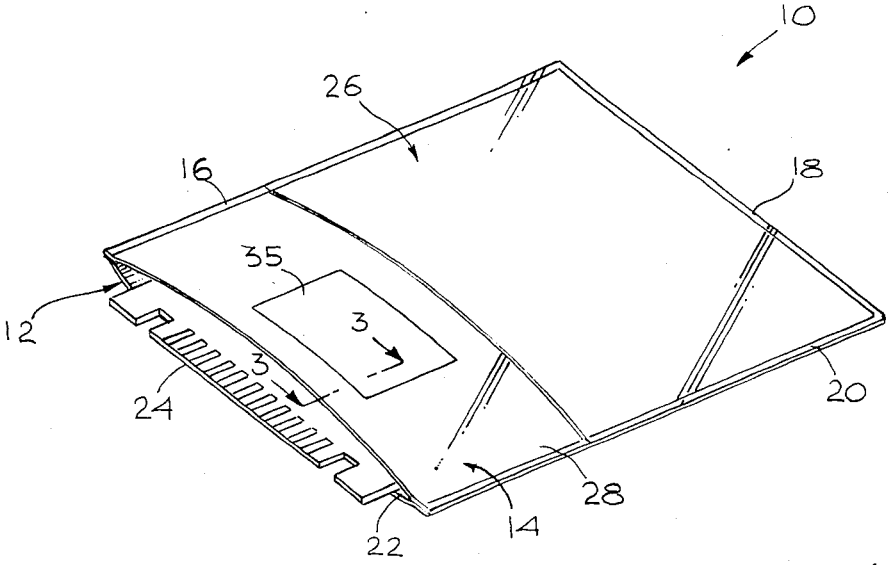
FIG. 1 is a simplified perspective view of a pouch formed in accordance with one embodiment of the invention.
Figure 3:
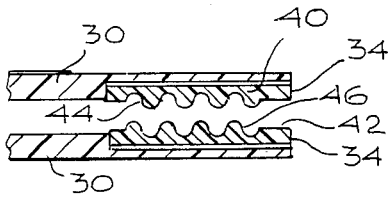
FIG. 3 is a cross-sectional view taken along line 3—3 of FIG. 1 (without the enclosed electronic component)

FIG. 1 is a simplified perspective view of a novel pouch 10 of the present invention. Pouch 10 comprises two composite panels 12 and 14 (described hereinafter in more detail with reference to FIGS. 2 and 3) sealed together at joints 16, 18 and 20, the end 22 of pouch 10, when open, allowing entry of an electrostatic sensitive electronic component such as printed circuit board 24. When the component 24 is fully within pouch 10, end 22 is closed by an interlocking device, one form of which is shown in FIG. 3, to substantially seal printed circuit board 24 within the pouch 10. A pocket 26, formed by a sheet of material having a length smaller than the top sheet 28 of panel 14, may be incorporated on pouch 10, pocket 26 being utilized to store, for example, reference materials relating to component contained within pouch 10.

As shown in the exploded view of FIG. 2, each pouch 10 consists of two composite panels 12 and 14 and an interlocking closure described hereinafter with reference to FIG. 3. Panels 12 and 14 each comprise, proceeding from the outside in, a conductive, heat-sealable, flexible material layer 30, preferably of plastic, and having a surface resistivity or specific resistance in a range from about $10^{-5}$ ohms/sq. to about $10^{5}$ ohms/sq. Suppliers of material meeting such requirements include Armand Manufacturing, Incorporated, Los Angeles, Calif. (material sold as Conductive Polyethylene) and Static Controls Division of 3M Company, St. Paul, Minn. (material sold as Velostat). Cushioning material 32 is then applied over each conductive layer 30, the cushioning material 32 comprising electrostatic-free and heat sealable material, preferably plastic, and having a surface resistivity or specific resistance in the range from $10^{9}$ ohms/sq. to about $10^{14}$ ohms/sq. Suppliers of material meeting these requirements include the Armand Manufacturing Company (material sold as Anti-Static Air Bubble) and Ade, Incorporated, Chicago, Ill. (material sold as Cancel).

Inner wall layers 34 comprise a material which is flexible, electrostatic-free and heat sealable. The material preferably has a surface resistivity in the range from about $10^{9}$ ohms/sq. to about $10^{14}$ ohms/sq. and also is impervious to water. Suppliers of material meeting this requirement include Ludlow Corporation, Holyoke, Mass. (material sold as Marvelguard ECIA), and the Richmond Division of Dixico, Incorporated, Redlands, Calif. (material sold as RCAS 1200). Pocket 26 comprises the material used for barrier layer 34 but is shorter in length than layer 30 and is provided as an option to form a storage pocket for documentation materials or the like to accompany the electronic component within the pouch. A print write-on area 35 is provided on layer 30 of panel 14 as illustrated.

FIG. 3 is a cross-sectional view along line 3—3 of FIG. 1 and illustrates how the interlocking closures are arranged within pouch 10. The interlocking closure as shown in FIG. 3 consists of two strips 40 and 42 with complementary grooved elements 44 and 46, respectively, and comprising electrostatic-free, heat sealable plastic material. The interlocking closure, similar to the sealing member configuration shown in U.S. Pat. No. 4,247,002 which is like the Ziplock closure available commercially, preferably has a resistivity in the range from about $10^{9}$ ohms/sq. to about $10^{14}$ ohms/sq. and is available from the Armand Manufacturing Company and the Richmond Division of the Dixico Corporation (material sold as RCAS 1200).

Figure 7:
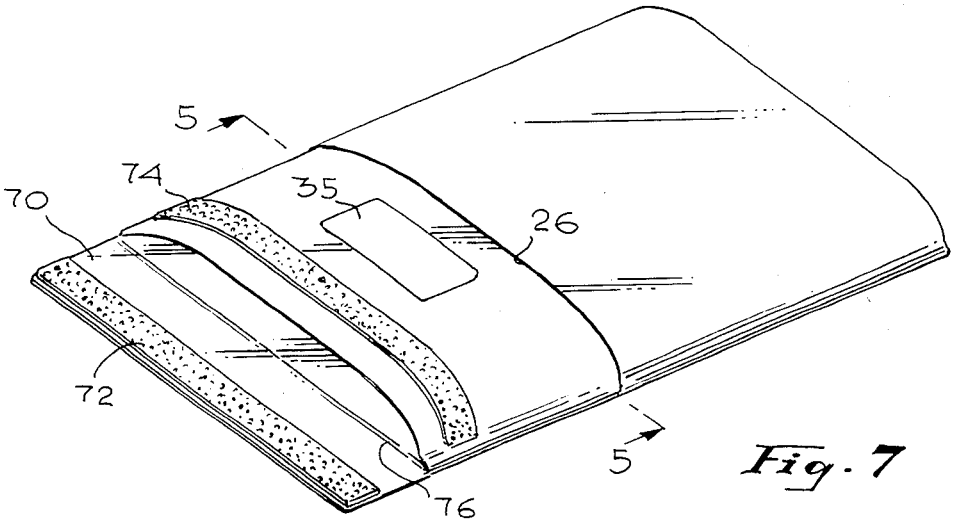
FIG. 7 is a perspective view of a finished pouch corresponding to the construction of either FIG. 5 or FIG. 6 and showing an alternative type of releasable closure.

The interlocking closure must be positioned within the pouch 10 and sealed to layers 34 such that conductive material 30 overlaps the component 24 to provide a Faraday cage (shielding) effect when the pouch is closed. It should be noted that other arrangements can be used for the interlocking closure, including a conductive zipper closure, thus eliminating the overlapping requirement set forth hereinabove, a Velcro closure as shown in FIG. 7, or other suitable closures, known in the art.

Figure 2:
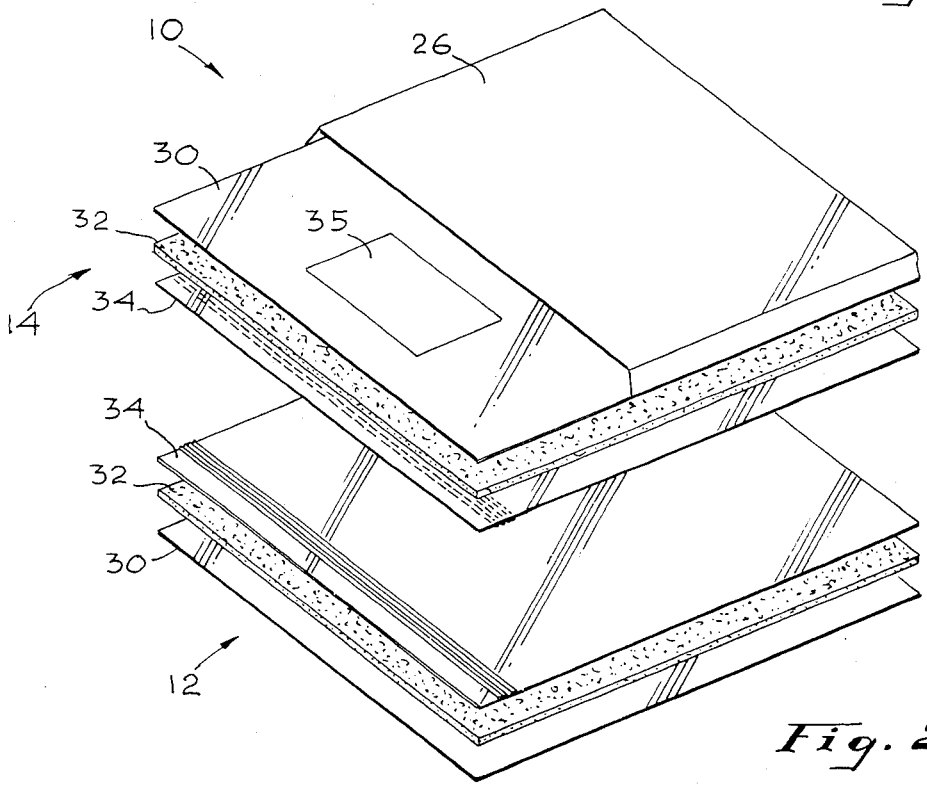
FIG. 2 is an exploded assembly view illustrating formation of the embodiment of FIG. 1.
Figure 4:
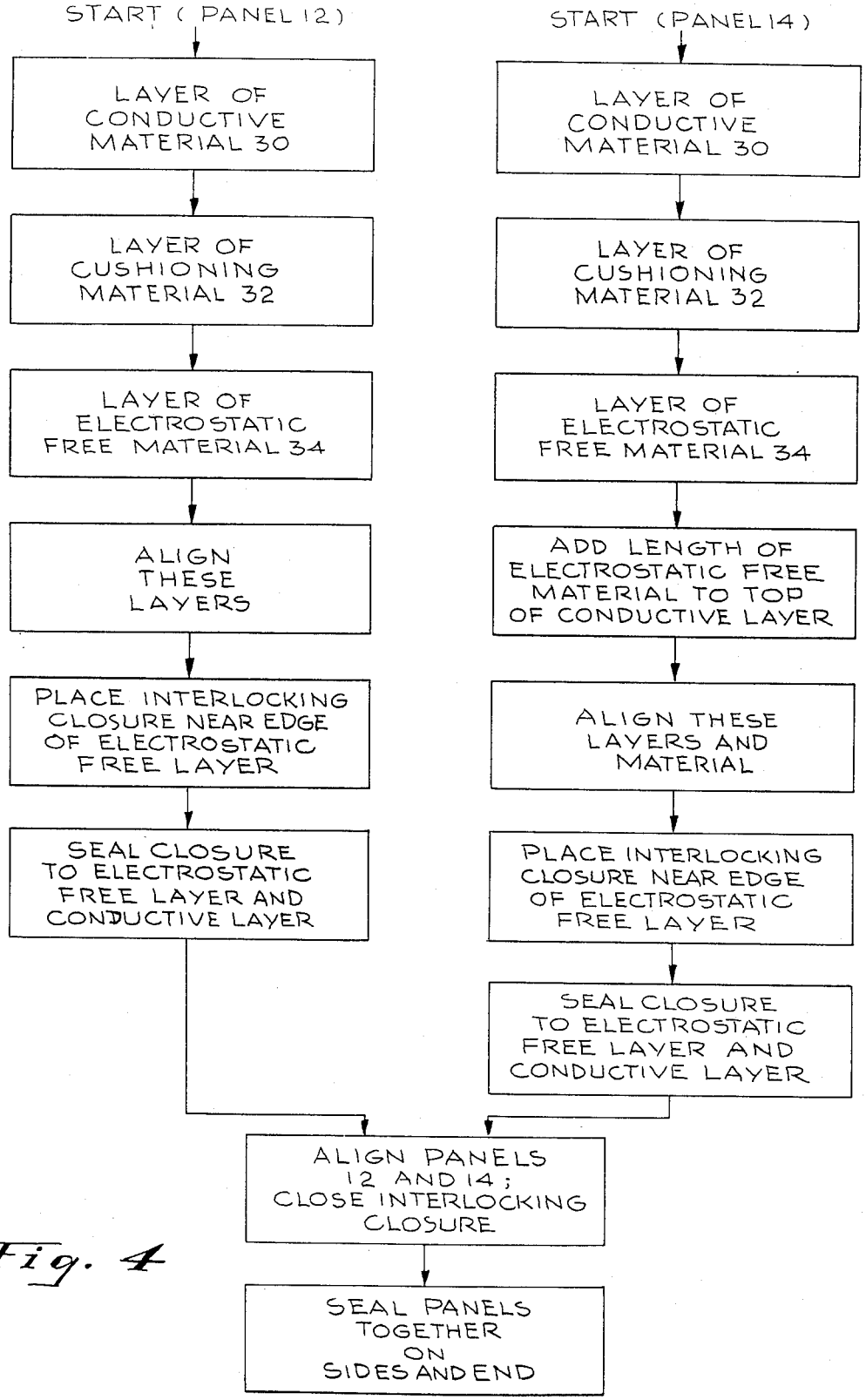
FIG. 4 is a diagram illustrating the process steps utilized in the fabrication of the embodiment of FIG. 1.

Referring now to FIG. 4, a block diagram of the process steps utilized in fabricating the embodiment of pouch 10 shown in FIG. 2 is illustrated. The depicted sequence of steps shows the fabrication of panels 12 and 14 in parallel, the process obviously also being accomplished in a sequential manner. Panel 12 is fabricated by providing a layer of conductive material 30, overlaying it with a layer of cushioning material 32 and then applying a layer of electrostatic-free material 34 over the layer of cushioning material 32. All three layers are then aligned and interlocking closure member 42 is placed near the edge of the electrostatic-free layer 34. A strip of interlocking closure material is heat sealed thereto and to the conductive plastic layer 30 which encloses cushioning material 32. The grooved elements 46 protrude from electrostatic-free material 34. The construction of the interlocking closure within the conductive material 30 must overlap in a manner to provide a Faraday-cage effect when pouch 10 is closed. The panel 14 is next fabricated by providing a layer of conductive material 30. A layer of cushioning material 32 is then applied over the layer of conductive material 30 and thereafter a layer of electrostatic-free material 34 is applied over the cushioning material layer 32. As an option, an added length of electrostatic-free material 28 may be added to the top of conductive layer 30 in a manner to form a pocket for receiving instructional or other reference materials associated with the electronic component 24 contained within pouch 10. Thereafter, the three layers and the added length of layer 28 are aligned and a second portion 40 of the interlocking closure is applied to the static-free material 34, sealing through to conductive layer 30. Both panels 12 and 14 are then aligned and the interlocking closure closed. Both panels are heat sealed through all the layers together to form sealed joints 16, 18 and 20 (FIG. 1).

The side seams 16 and 20 are preferably parallel to each other and at right angles to the end seam 18 and the interlocking closure at end 22. The seam width, length and strength are at least the minimum standards required for heat sealing. It should be noted that other techniques of sealing panel 12 to panel 14 may be utilized. For example, the sides could be taped, stitched (sewed), stapled or glued together. A white write-on area 35 (FIGS. 1 and 2) may be provided on conductive layer 30 to allow for user information to be recorded and sensitive electronic device symbols and associated caution warnings to be placed on the outside of conductive layer 30 on each side as designated.

In essence, pouch 10 will contain an electrostatic sensitive component 24. The electrostatic-free layer 34 will prevent triboelectric charging and the open cell cushioning layer 32 will blunt sharp edges and leads from damage or from piercing the conductive layer 30. The conductive layer 30 will, when completely zipped closed, provide a Faraday cage shield from electromagnetic induction fields that could damage static-sensitive components. The interlocking closure ensures easy opening and closing for step-by-step assembly production. The outside half-sleeve pocket 26 can carry all necessary paperwork, for example, for production of the component. The printed write-on area 35 facilitates ship-out and receiving by identifying component 24 by part number. The printed caution and warning label draws attention to the sensitivity of component 24 and instructs the person handling the pouch not to open it in an unacceptable area so as to avoid causing damage to component 24.

Printing on the area 35 does not affect the conductive characteristics of layer 30 (in contradistinction thereto, printing on electrostatic-free plastic materials, such as layer 34, will degrade its electrostatic-free properties).

Figure 5:
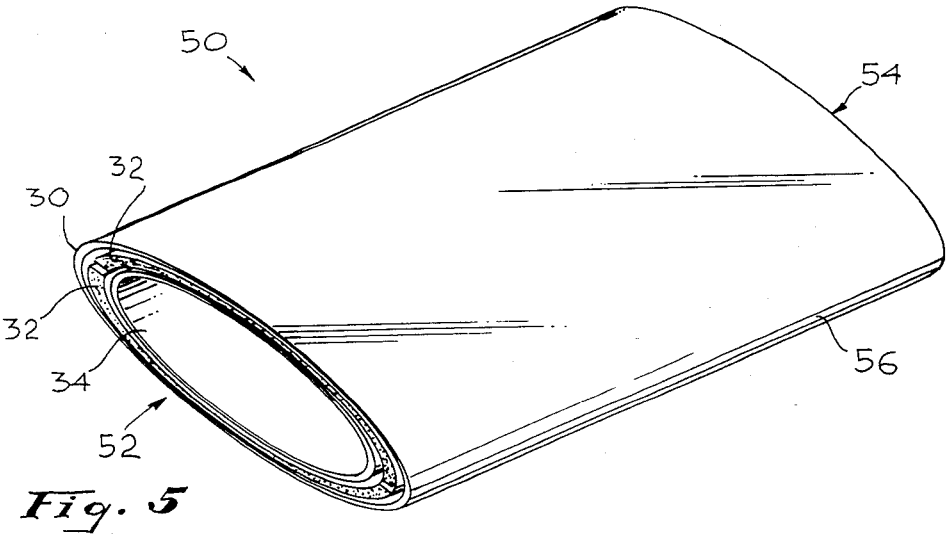
FIG. 5 is a partial sectional view of a second embodiment of the invention, the section being taken along the line 5–5 of FIG. 7.

FIG. 5 shows a pouch 50 fabricated in accordance with an alternative embodiment of the invention. In this embodiment, conductive material 30 is formed as a tubular member, as by extrusion in the direction of the longitudinal axis. Barrier layer 34 is also formed in the same fashion, this inner layer having a smaller diameter than the outer layer 30. The inner layer is positioned concentrically in the outer layer and two sheets of cushioning material 32 are sandwiched between the inner and outer layers, as shown. The end 54 is sealed to close both the inner tubular member 34 and the outer tubular member 30, and a crimp line 56 is established so that the pouch 50 will be of generally flat configuration. A flap closure, such as the member 70, shown in FIG. 7, may be provided having a Velcro strip 72 mounted thereon for engaging a mating Velcro strip 74, positioned along the outer surface of the other side of the pouch, when the flap 70 is folded over the open end along a fold line 76.

Figure 6:
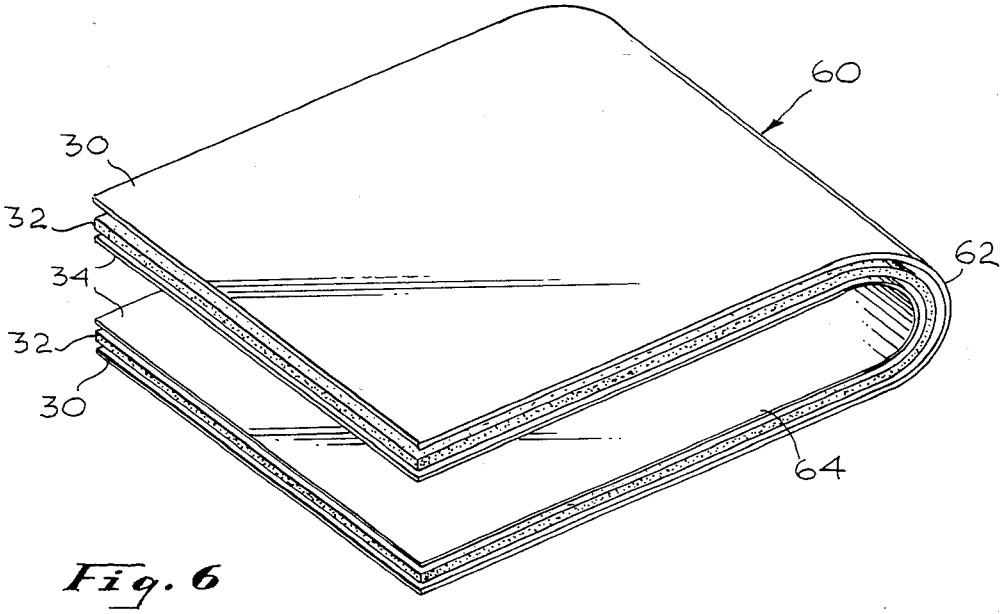
FIG. 6 is a perspective view, partially broken away, showing details of construction of still another embodiment of the invention.

FIG. 6 is a partially broken away view of a pouch 60 fabricated in accordance with yet another embodiment of the invention. In this embodiment, a sandwich of outer layer material 30, intermediate cushioning material 32 and inner layer material 34 is fabricated in a length approximately twice the length of the pouch being manufactured. This sandwich assembly is then folded in half, crosswise, to establish the closed end 62 of the pouch. Sealing is then effected along the side edges 64 in the manner already described, as represented in FIG. 7, for example. A releasable closure is provided at the open end of the pouch 60 like that shown in FIG. 7. Alternatively, the interlocking closure of FIG. 3 may be utilized.

Although there have been described above specific arrangements of an electrostatic-sensitive component carrying pouch in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A method for fabricating a reusable pouch for containing electro-sensitive electronic components comprising the steps of:

(a) forming a first panel by:
- providing a first layer of conductive material;
- placing a first layer of cushioning material on said first layer;
- placing a first layer of electrostatic-free material on top of said layer of cushioning material;
- aligning said first layers;
- sealing a first interlocking closure strip to said electrostatic-free material and to the conductive material on opposite sides of the cushioning material;

(b) forming a second panel by:
- providing a second layer of conductive material;
- placing a second layer of cushioning material on said second layer;
- placing a second layer of electrostatic-free material on the top of said layer of cushioning material;
- aligning said second layers to each other;
- sealing a second interlocking closure strip to said second layer of electrostatic-free material and to the second layer of conductive material, the second strip being selected to matingly engage with the first strip;

(c) inverting the second panel and placing it adjacent the first panel with the closure strips and conductive layers facing one another, respectively;

(d) aligning said first and second panels while interlocking said first and second closure strips; and (e) sealing all said layers together on both side edges and the bottom edge to form a pouch which can be opened and closed by unlocking and interlocking the closure strips.

2. The method as defined in claim 1 further including the steps of adding a third layer of electrostatic-free material to the outside of one of said first and second conductive layers, said third layer having a length less than said one of the first and second conductive layers.

3. The method as defined in claim 1 wherein all of said layers are of heat sealable material and said sealing is accomplished by heat sealing.

4. The method as defined in claim 1 wherein said interlocking enclosure overlaps with said conductive material in a manner which provides a Faraday cage effect when the pouch is closed.

* * * * *